US008104767B2

(12) United States Patent
Tseng

(10) Patent No.: US 8,104,767 B2
(45) Date of Patent: Jan. 31, 2012

(54) AUTOMATIC POKER SHUFFLING MACHINE

(76) Inventor: Tzu-Hsiang Tseng, Taichung (TW)

( * ) Notice: Subject to any disclaimer, the term of this patent is extended or adjusted under 35 U.S.C. 154(b) by 216 days.

(21) Appl. No.: 12/656,922

(22) Filed: Feb. 19, 2010

(65) Prior Publication Data

US 2011/0175285 A1 Jul. 21, 2011

(30) Foreign Application Priority Data

Jan. 21, 2010 (TW) ..... 99101686 A

(51) Int. Cl.
*A63F 1/12* (2006.01)

(52) U.S. Cl. ..... 273/149 R

(58) Field of Classification Search ..... 273/149 R, 273/149 P; 463/22

See application file for complete search history.

(56) References Cited

U.S. PATENT DOCUMENTS 4,586,712 A * 5/1986 Lorber et al. ..... 273/149 R
4,659,082 A * 4/1987 Greenberg ..... 273/149 R
5,000,453 A * 3/1991 Stevens et al. ..... 273/149 R
5,676,372 A * 10/1997 Sines et al. ..... 273/149 R
6,139,014 A * 10/2000 Breeding et al. ..... 273/149 R

* cited by examiner

*Primary Examiner* — Benjamin Layno
(74) *Attorney, Agent, or Firm* — Bacon & Thomas, PLLC

(57) ABSTRACT

An automatic poker shuffling machine includes a card dispensing device having a vertically movable platform and a first conveyer mounted to the platform; a card cartridge installed on the platform for placing poker cards thereon, the first conveyer being stopped against the poker cards for controllably conveying the poker cards outward; a card collecting device having a movable indexing member and a plurality of card holders mounted to the movable indexing member, a movable indexing member being able to enable the card holders to face the card cartridge alternately for collecting the poker cards conveyed from the card cartridge; and a card retrieving device having a second conveyer corresponding to the card cartridge and to be stopped against the poker cards in the corresponding card holder for controllably pushing the poker cards back to the card cartridge. Therefore, automatic poker shuffling machine has low failure rate and reparative difficulty.

10 Claims, 6 Drawing Sheets

AUTOMATIC POKER SHUFFLING MACHINE

BACKGROUND OF THE INVENTION

1. Field of the Invention

The present invention relates generally to a gaming machine, and more particularly, to an automatic poker shuffling machine.

2. Description of the Related Art

To pursue high justice of the poker game and eliminate inequable shuffle or human manipulation, most of the gaming providers have adopted the automatic poker shuffling machine instead of the manual shuffle to randomize the poker points and suits.

However, the commercially available automatic poker shuffling machine can though do the job mentioned above, its structure is generally complicated, and especially the required components, like rollers, for dispensing and cutting poker cards are too many in number. For this reason, such automatic poker shuffling machine is subject to malfunction while operated and it is not easy to repair the structurally complicated machine under malfunction.

SUMMARY OF THE INVENTION

The primary objective of the present invention is to provide an automatic poker shuffling machine, which is structurally simple and whose failure rate and reparative difficulty are low.

The foregoing objective of the present invention is attained by the automatic poker shuffling machine composed of a card dispensing device, a card cartridge, a card collecting device, and a card retrieving device. The card dispensing device includes a platform and a first conveyer. The platform is vertically movable and the first conveyer is mounted to the platform. The card cartridge is installed to the platform for placing poker cards therein. The first conveyer is stopped against the poker cards and can be controlled to convey the poker cards outward. The card collecting device includes a movable indexing member and a plurality of card holders mounted to the movable indexing member. The movable indexing member can be controlled for movement to further enable the card holders to face the card cartridge alternately. The card holders can collect the poker cards conveyed from the card cartridge. The card retrieving device includes a second conveyer corresponding to the card cartridge and stopped against the poker cards in the corresponding card holder. The card retrieving device can be controlled to push the poker cards back to the card cartridge.

DETAILED DESCRIPTION OF PREFERRED EMBODIMENTS

Figure 1:
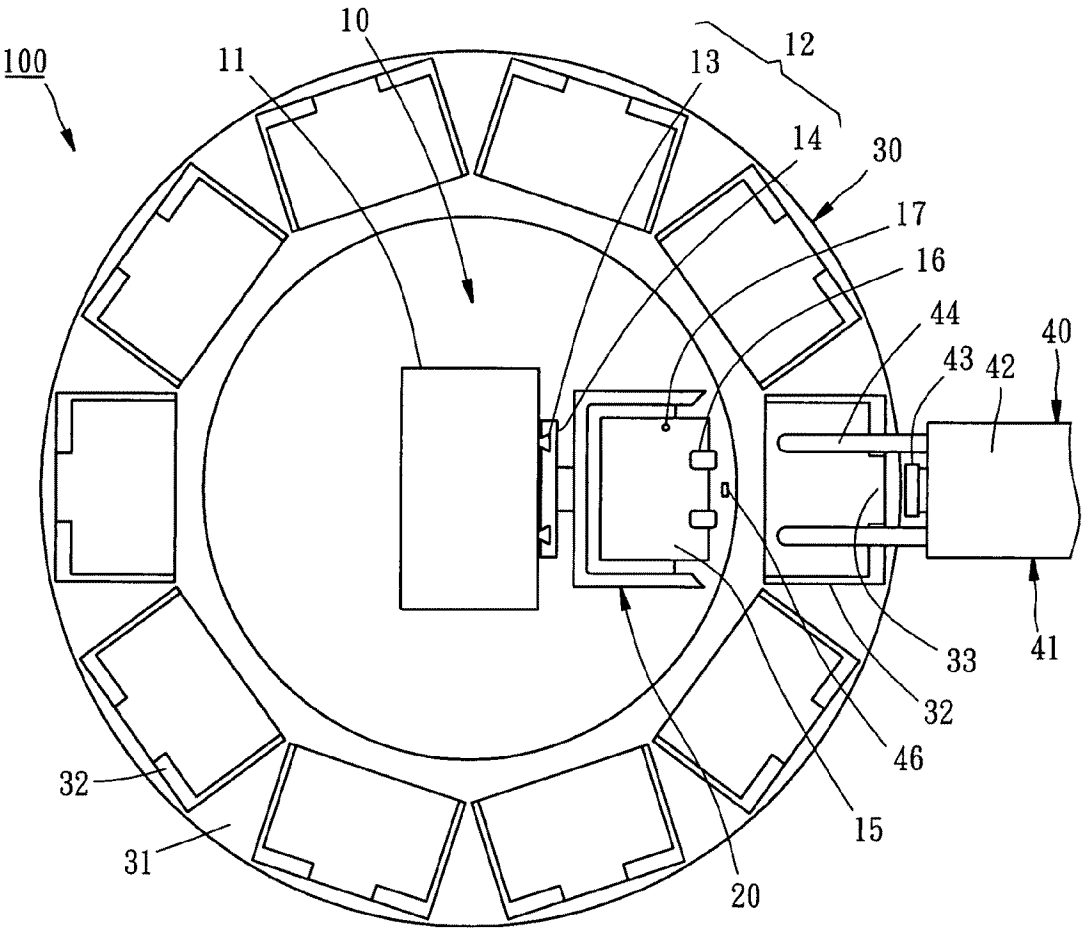
FIG. 1 is a top view of a first preferred embodiment of the present invention.
Figure 2:
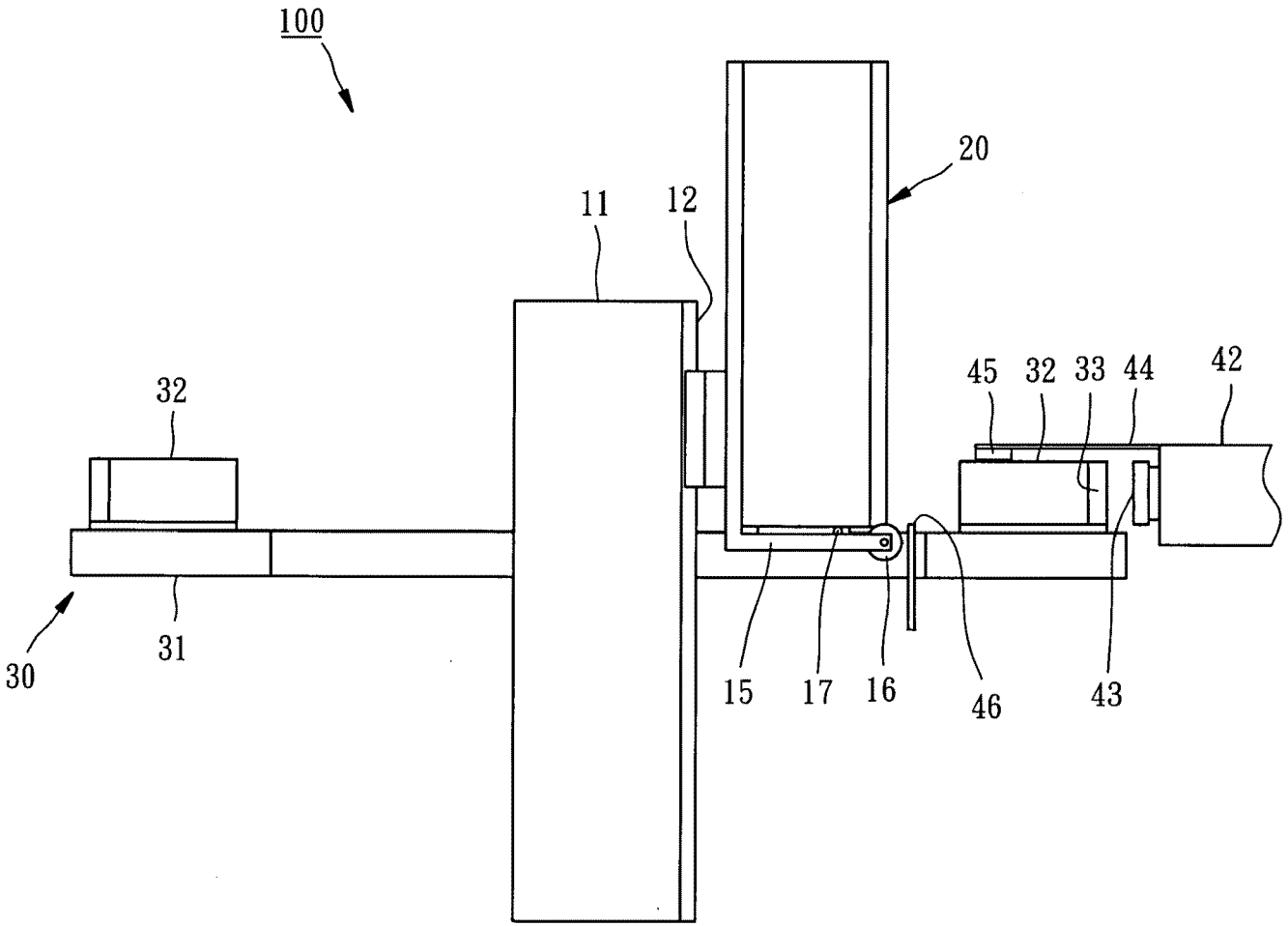
FIG. 2 is a side view of the first preferred embodiment of the present invention.

Referring to FIGS. 1-6, an automatic poker shuffling machine 100 constructed according to a first preferred embodiment of the present invention is composed of a card dispensing device 10, a card cartridge 20, a card collecting device 30, and a card retrieving device 40. These components are structurally illustrated in details as well as their interrelationships in the following respective paragraphs.

The card dispensing device 10 includes an upright frame body 11, a vertical linear slide member 12 mounted to the frame body 11, a first conveyer 16, and a sensor 17. The vertical linear slide member 12 has two linear slideways 13 mounted to the frame body 11, a slide member 14 slidably mounted to the two linear slideways 13, and a platform 15 connected with the slide member 14 for vertical movement under control. The card cartridge 20 can be installed onto the platform 15 for placing poker cards P therein. The first conveyer 16 is a roller in this embodiment, but not limited to the roller, and can be stopped against a bottommost part of the whole poker cards P. The first conveyer 16 can be controlled to roll and convey each of the poker cards P outward from the card cartridge 20 in turn. The sensor 17 is provided for detecting whether the poker cards P are still available in the card cartridge 20 and for outputting a signal to stop the first conveyer 16 from rolling when the poker cards P are not available in the card cartridge 20.

The card collecting device 30 includes a horizontally movable indexing member 31 and a plurality of card holders 32 mounted to the movable indexing member 31. In this embodiment, the movable indexing member 31 is annular in shape and surrounds the card dispensing device 10 to save the whole space. The movable indexing member 31 can be based on a conventional way, like gears engaged with each other, and controlled by a driving device (not shown) for randomization and indexing rotation. In this way, the card holders 32 can be moved to randomly face the card cartridge 20 for receiving the poker cards P conveyed from the card cartridge 20. Each of the card holders 32 in this embodiment is a box, whose top side is hollow and which has an opening 33 formed at one side thereof.

The card retrieving device 40 is fixedly located outside the movable indexing member 31 and includes a second conveyer 41 and a bar set 44. The second conveyer 41 corresponds to the card cartridge 20 in location and has a reciprocating member 42, like an electric cylinder, and a push-back member 43. The push-back member 43 can be controlled by the reciprocating member 42 to enter or exit the opening 33 of the card holder 32 by horizontally reciprocating movement so as to push the poker cards P back to the card cartridge 20. In addition, the second conveyer 41 can also be a roller or an alternative conveying structure. In this embodiment, the bar set 44 is hung above the corresponding card holder 32 for limiting the poker cards conveyed from the card cartridge 20 to the corresponding card holder 32. A first sensor 45 is mounted to a bottom side of the bar set 44 for detecting each of the poker cards P conveyed from the card cartridge 20 to the corresponding card holder 32. A processor (not shown) can calculate and record the number of the poker cards P entering each of the card holders 32. Besides, the card retrieving device 40 further includes a second sensor 46 corresponding to the card cartridge 20 for detecting the height of the poker cards P in the card cartridge 20 and then transmitting a corresponding signal to enable the card dispensing device 10 to have the platform 15 lower down to a corresponding position to allow the poker cards P to be pushed back to the card cartridge 20.

Figure 3:
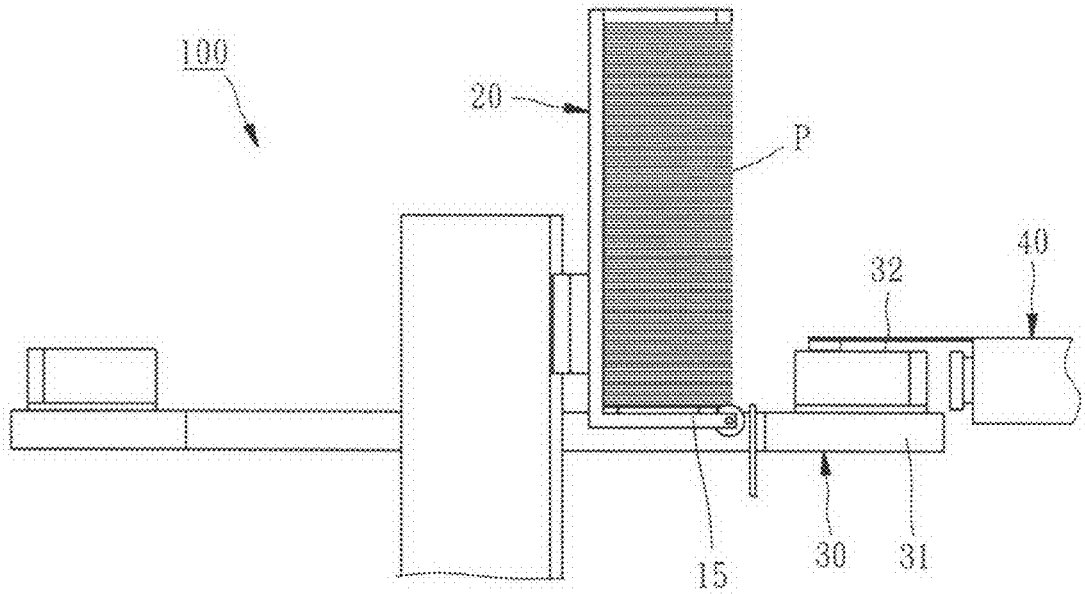
FIGS. 3-6 are side views of the first preferred embodiment of the present invention, showing the shuffling process of the poker cards.
Figure 4:
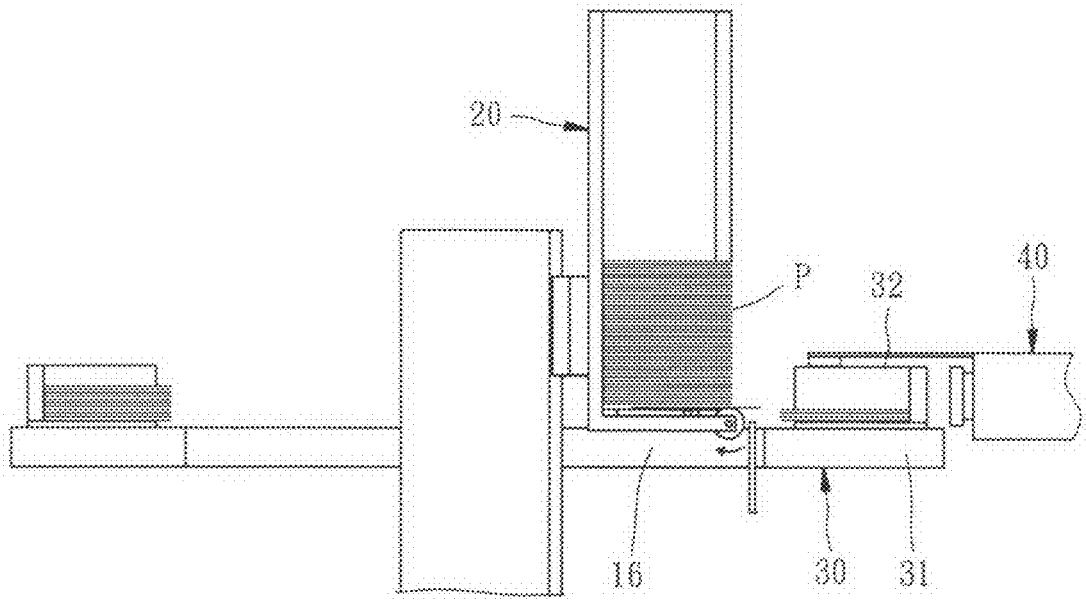
Figure 5:
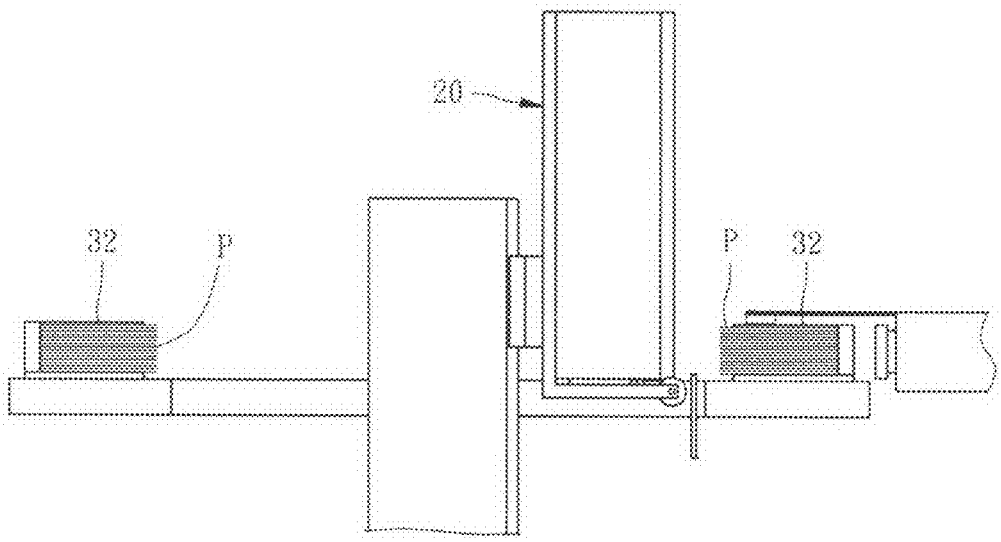
Figure 6:
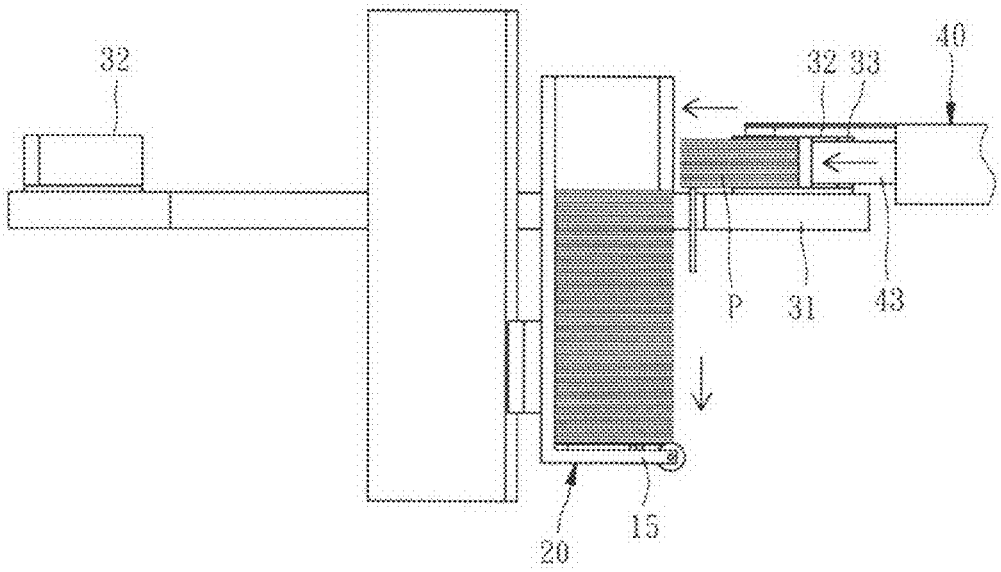

Before the actual shuffle proceeds, multiple packs of the poker cards P are placed in the card cartridge 20, as shown in FIG. 3. Next, when the actual shuffle proceeds, the card collecting device 30 is activated to enable the movable indexing member 31 to do randomly indexing rotation and when either of the card holders 32 is moved to face the card cartridge 20, the card dispensing device 10 randomly dispenses some of the poker cards P in inconsistent number to that corresponding card holder 32, as shown in FIG. 4. After a while, the poker cards P in the card cartridge 20 are not available, as shown in FIG. 5, but are randomly dispensed to the card holders 32 separately. In the meantime, the card collecting device 40 is activated to push the poker cards P in the card holders 32 back to the card cartridge 20 via the vertical movement of the platform 15 as well as the indexing rotation of the movable indexing member 31 again. After the shuffle is completed, the poker cards P have been randomly dispensed and retrieved, such that the poker cards P can be randomly arranged for more gaming justice after the aforesaid shuffle is repeated once or twice more. Preferably, the number of the card holders 32 is larger than the pack number of the poker cards P to further decrease the frequency of the shuffle or to increase the degree of randomness of the poker cards P.

In light of the above, the present invention only includes the card dispensing device 10, the card collecting device 30, and the card retrieving device 40, all of which work simply and are arranged delicately to simplify the whole structure of the present invention. Besides, all of the elements of the aforesaid devices are very few, e.g. there could be only one roller or none of any roller is required. Therefore, the present invention can have lower failure rate and be repaired easier than the prior art.

Figure 7:
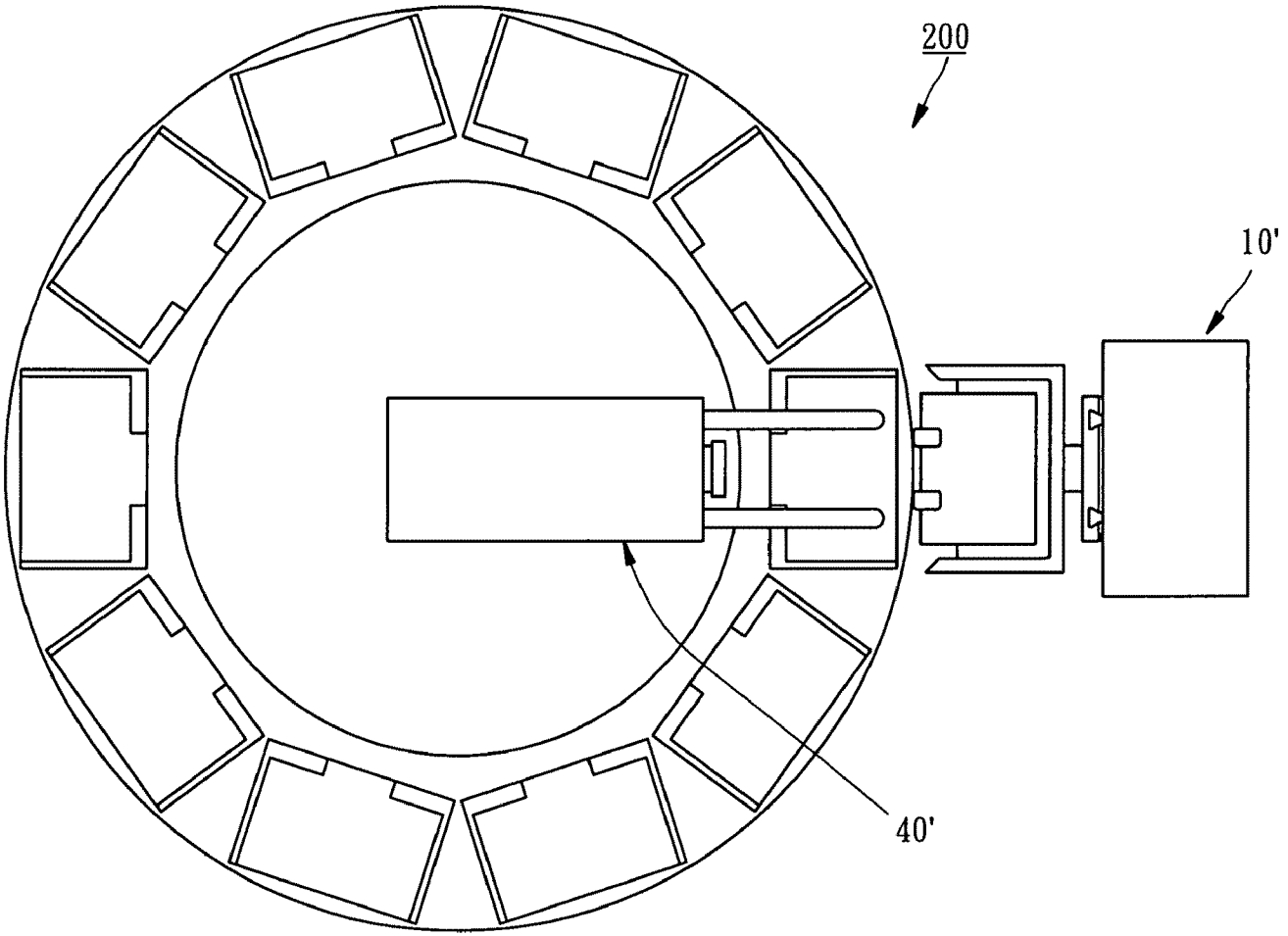
FIG. 7 is a top view of a second preferred embodiment of the present invention.

Referring to FIG. 7, an automatic poker shuffling machine 200 constructed according to a second preferred embodiment of the present invention is similar to that of the first embodiment, having the following difference. The card dispensing device 10' and the card retrieving device 40' are interchanged in position and can attain the same effect of the present invention.

Figure 8:
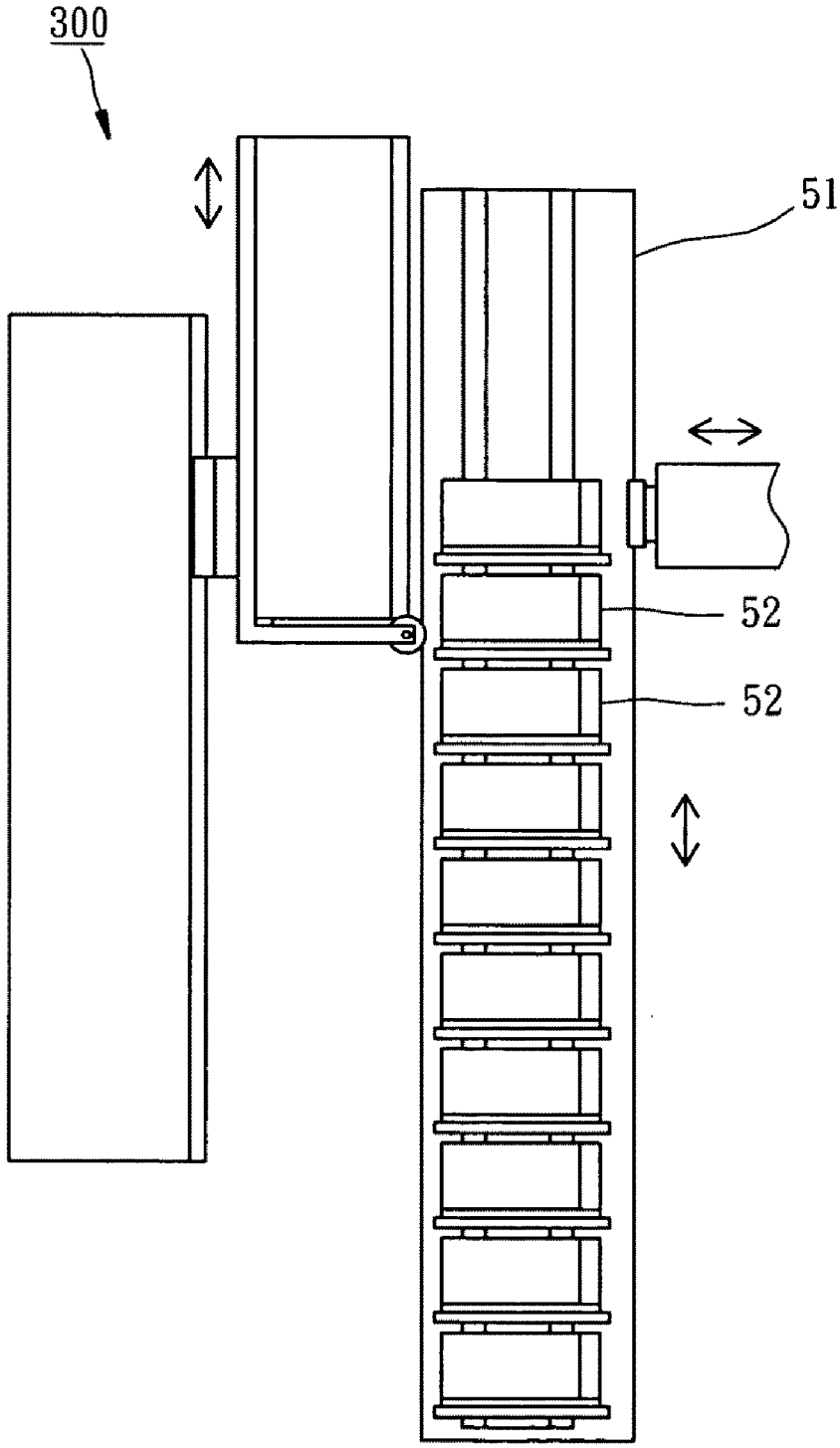
FIG. 8 is a side view of the second preferred embodiment of the present invention.

Referring to FIG. 8 an automatic poker shuffling machine 300 constructed according to a third preferred embodiment of the present invention is similar to that of the first embodiment, having the following difference. The movable indexing member 51 of the card collecting device 50 is linearly upright to have the card holders 52 arranged linearly vertically so as to attain the same effect.

Although the present invention has been described with respect to specific preferred embodiments thereof, it is in no way limited to the specifics of the illustrated structures but changes and modifications may be made within the scope of the appended claims.

What is claimed is:

1. An automatic poker shuffling machine comprising:

a card dispensing device having a platform and a first conveyer, the platform being vertically movable, the first conveyer being mounted to the platform;

a card cartridge installed to the platform for placing poker cards therein, the first conveyer being stopped against the poker cards for controllably conveying the poker cards outward from the card cartridge;

a card collecting device having a movable indexing member and a plurality of card holders mounted to the movable indexing member, the movable indexing member being capable of enabling the card holders to face the card cartridge alternately, the card holders being provided for collecting the poker cards conveyed from the card cartridge; and a card retrieving device having a second conveyer corresponding to the card cartridge and to be stopped against the poker cards in the corresponding card holder for controllably pushing the poker cards back to the card cartridge.

2. The automatic poker shuffling machine as defined in claim 1, wherein the movable indexing member is annular in shape and horizontally arranged.

3. The automatic poker shuffling machine as defined in claim 2, wherein the movable indexing member surrounds the card dispensing device.

4. The automatic poker shuffling machine as defined in claim 1, wherein the card dispensing device comprises a vertical linear slide member and the platform is mounted onto the vertical linear slide member.

5. The automatic poker shuffling machine as defined in claim 1, wherein the card retrieving device comprises a bar set for limiting the poker cards conveyed from the card cartridge to the corresponding card holders alternately.

6. The automatic poker shuffling machine as defined in claim 1, wherein the card retrieving device comprises a first sensor and a processor for detecting and calculating the number of the poker cards conveyed to each of the card holders.

7. The automatic poker shuffling machine as defined in claim 1, wherein the card retrieving device comprises a second sensor for detecting the height of the poker cards in the card cartridge.

8. The automatic poker shuffling machine as defined in claim 1, wherein the second conveyer comprises a reciprocating member and a push-back member connected with the reciprocating member.

9. The automatic poker shuffling machine as defined in claim 1, wherein the movable indexing member is linear in shape and vertically arranged to face the card dispensing device.

10. The automatic poker shuffling machine as defined in claim 1, wherein the number of the card holders is larger than the pack number of the poker cards in the card cartridge.

* * * * *